US009647358B2

(12) United States Patent
Tsai et al.

(10) Patent No.: US 9,647,358 B2
(45) Date of Patent: May 9, 2017

(54) ELECTRICAL PLUG CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Yang-Yang Zhou, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/065,069

(22) Filed: Mar. 9, 2016

(65) Prior Publication Data

US 2016/0268746 A1 Sep. 15, 2016

(30) Foreign Application Priority Data

Mar. 9, 2015 (CN) ..... 2015 1 0103637

(51) Int. Cl.

| | |
|---|---|
| ***H01R 24/70*** | (2011.01) |
| ***H01R 12/70*** | (2011.01) |
| ***H01R 13/6585*** | (2011.01) |
| ***H01R 24/62*** | (2011.01) |
| *H01R 12/71* | (2011.01) |
| *H01R 12/72* | (2011.01) |

(52) U.S. Cl.

CPC ..... *H01R 12/7052* (2013.01); *H01R 13/6585* (2013.01); *H01R 24/62* (2013.01); *H01R 12/716* (2013.01); *H01R 12/724* (2013.01)

(58) Field of Classification Search

CPC ..... H01R 13/655; H01R 13/5202; H01R 13/6587

See application file for complete search history.

(56) References Cited

U.S. PATENT DOCUMENTS

| | | | | |
|---|---|---|---|---|
| 8,011,956 | B1 * | 9/2011 | Yang | H01R 13/5202 439/589 |
| 8,323,057 | B2 * | 12/2012 | Ho | H01R 12/725 439/607.4 |
| 2013/0178094 | A1 * | 7/2013 | Huang | H01R 24/60 439/490 |
| 2013/0316581 | A1 * | 11/2013 | Kao | H01R 13/6471 439/607.28 |
| 2014/0194005 | A1 * | 7/2014 | Little | H01R 13/6585 439/607.28 |

* cited by examiner

*Primary Examiner* — Briggitte R Hammond

(57) ABSTRACT

An electrical plug connector includes an insulated housing, a plurality of terminals, a metallic shell, and a positioning plate. The insulated housing includes a base portion, an upper portion, and a lower portion. The upper portion and the lower portion are extending from one side of the base portion. A mating room is between the upper portion and the lower portion. The terminals are held in the insulated housing. The metallic shell includes a tubular portion and a receiving cavity defined in the tubular portion. The insulated housing is received in the receiving cavity. The positioning plate is at the rear of the metallic shell to enclose the base portion. The positioning plate includes a first leg and a second leg respectively located at two sides of the base portion, so that the positioning plate can be assembled with a circuit board stably.

11 Claims, 12 Drawing Sheets

| | | | | | | | | | | | |
|---|---|---|---|---|---|---|---|---|---|---|---|
| GND | RX2+ | RX2- | VBUS | RFU | D- | D+ | CC1 | VBUS | TX1- | TX1+ | GND |
| GND | TX2+ | TX2- | VBUS | CC2 | D+ | D- | RFU | VBUS | RX1- | RX1+ | GND |

21

22

Fig. 4C

ELECTRICAL PLUG CONNECTOR

CROSS-REFERENCES TO RELATED APPLICATIONS

This non-provisional application claims priority under 35 U.S.C. §119(a) on Patent Application No. 201510103637.8 filed in China, P.R.C. on 2015/03/09, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

An existing USB electrical plug connector includes a shell, an insulated housing, and a plurality of transmission terminals. The transmission terminals are assembled in the insulated housing, and the shell encloses the insulated housing. When the USB electrical plug connector is mated with a USB electrical receptacle connector, one side of the insulated housing is inserted into the USB electrical receptacle connector, so that the transmission terminals are in contact with the receptacle terminals inside the USB electrical receptacle connector. Therefore, signals can be transmitted between the plug connector and the receptacle connector.

However, the shell covers the front of the insulated housing, but not the rear of the insulated housing. Therefore, a base portion of the insulated housing is exposed from the rear of the insulated housing. In addition, the USB electrical plug connector further includes a circuit board assembled at the bottom of the base portion, and the end portions of the transmission terminals are soldered with the circuit board. Commonly, the end portions of the transmission terminals would be departed from the circuit board easily when the USB electrical plug connector is bent, during the USB electrical plug connector is plugged into or departed from the USB electrical receptacle connector. In other words, the rear of the insulated housing is devoid of a structure for positioning with the circuit board, so that the bending resistance between the circuit board and the insulated housing is less sufficient.

SUMMARY OF THE INVENTION

Consequently, how to improve the existing electrical plug connector becomes an issue.

In view of these, an exemplary embodiment of the instant disclosure provides an electrical plug connector comprising an insulated housing, a plurality of upper-row plug terminals, a plurality of lower-row plug terminals, a metallic shell, and a positioning plate. The insulated housing comprises a base portion, an upper portion, a lower portion, and a mating room. The upper portion and the lower portion are extending from one side of the base portion. The mating room is between the upper portion and the lower portion. The upper portion has an upper mating face. The lower portion has a lower mating face. The upper mating face faces toward the lower mating face. The upper-row plug terminals are held in the insulated housing and located upon the upper mating face of the upper portion. The upper-row plug terminals comprise a plurality of upper signal pairs, at least one power terminal, and at least one ground terminal. The lower-row plug terminals are held in the insulated housing and located upon the lower mating face of the lower portion. The lower-row plug terminals comprise a plurality of lower signal pairs, at least one power terminal, and at least one ground terminal. The metallic shell comprises a tubular portion and a receiving cavity defined in the tubular portion. The insulated housing is received in the receiving cavity of the tubular portion. The positioning plate is at the rear of the metallic shell. The positioning plate comprises a first leg and a second leg respectively located at two sides of the base portion.

In one embodiment, the positioning plate and the metallic shell are integrally formed as a whole. The positioning plate is extending from the rear of the tubular portion to enclose the base portion. The positioning plate comprises a plurality of buckling sheets assembled to the top and the bottom of the base portion, respectively. The top and the bottom of each of the legs are abutted between the buckling sheets.

In one embodiment, the positioning plate and the metallic shell are separated pieces. The positioning plate comprises a top plate assembled to the top of the base portion. Each of the legs is extending from two sides of the top plate. The positioning plate further comprises a plurality of side plates located at two sides of the top plate and assembled to the two sides of the base portion. The metallic shell comprises a plurality of buckling pieces extending from the rear of the tubular portion to be assembled on the top and the bottom of the base portion.

In one embodiment, the electrical plug connector further comprises a circuit board assembled to the bottom of the base portion. The circuit board comprises a plurality of through holes and a plurality of contacts. The through holes are positioned with the legs. The contacts are soldered with the upper-row plug terminals and the lower-row plug terminals. In addition, the electrical plug connector further comprises a grounding plate disposed at the insulated housing, between the upper-row plug terminals and the lower-row plug terminals, and in contact with the circuit board.

In one embodiment, each of the upper-row plug terminals further comprises a flexible contact portion, a body portion, and a tail portion. The body portion is held in the upper portion, the flexible contact portion is extending forward from the body portion in the rear-to-front direction and partly exposed upon the upper mating face of the upper portion, and the tail portion is extending backward from the body portion in the front-to-rear direction and protruded from the insulated housing.

In one embodiment, each of the lower-row plug terminals further comprises a flexible contact portion, a body portion, and a tail portion. The body portion is held in the lower portion. The flexible contact portion is extending forward from the body portion in the rear-to-front direction and partly exposed upon the lower mating face of the lower portion, and the tail portion is extending backward from the body portion in the front-to-rear direction and protruded from the insulated housing.

In one embodiment, the upper-row plug terminals and the lower-row plug terminals have 180 degree symmetrical design with respect to a central point of the receiving cavity as the symmetrical center.

In one embodiment of the instant disclosure, an electrical plug connector comprises an insulated housing, a plurality of upper-row plug terminals, a metallic shell, and a positioning plate. The insulated housing comprises a base portion, an upper portion, a lower portion, and a mating room. The upper portion and the lower portion are extending from one side of the base portion. The mating room is between the upper portion and the lower portion. The upper portion has an upper mating face. The lower portion has a lower mating face. The upper mating face faces toward the lower mating face. The upper-row plug terminals are held in the insulated housing and located upon the upper mating face of the upper portion. The upper-row plug terminals comprise a plurality of upper signal pairs, at least one power terminal, and at least one ground terminal. The metallic shell comprises a tubular portion and a receiving cavity defined in the tubular portion. The insulated housing is received in the receiving cavity of the tubular portion. The positioning plate is at the rear of the metallic shell. The positioning plate comprises a first leg and a second leg respectively located at two sides of the base portion.

In one embodiment of the instant disclosure, an electrical plug connector comprises an insulated housing, a plurality of lower-row plug terminals, a metallic shell, and a positioning plate. The insulated housing comprises a base portion, an upper portion, a lower portion, and a mating room. The upper portion and the lower portion are extending from one side of the base portion. The mating room is between the upper portion and the lower portion. The upper portion has an upper mating face. The lower portion has a lower mating face. The upper mating face faces toward the lower mating face. The lower-row plug terminals are held in the insulated housing and located upon the upper mating face of the upper portion. The lower-row plug terminals comprise a plurality of lower signal pairs, at least one power terminal, and at least one ground terminal. The metallic shell comprises a tubular portion and a receiving cavity defined in the tubular portion. The insulated housing is received in the receiving cavity of the tubular portion. The positioning plate is at the rear of the metallic shell. The positioning plate comprises a first leg and a second leg respectively located at two sides of the base portion.

Based on the above, the legs of the positioning plate are located at the two sides of the base portion, extending from the bottom of the base portion, and assembled to the circuit board, so that the legs can be soldered with the circuit board, and the fixation between the base portion and the circuit board can be improved. As a result, the insulated housing would not detach from the circuit board easily when a bending test is applied to the electrical plug connector, and the tail portions of the upper-row plug terminals and the tail portions of the lower-row plug terminals would not detach from the circuit board. Consequently, the fixation between the insulated housing and the circuit board, and the structural strength of the electrical plug connector can be improved efficiently. In addition to the soldering between the plug terminals of the electrical plug connector and the contacts of the circuit board, the legs of the positioning plate are engaged with the circuit board, so that the fixation between the electrical plug connector and the circuit board can be further improved. Therefore, after the electrical plug connector is plugged or unplugged into an electrical receptacle connector for several times, the electrical plug connector would not be tilted with respect to the circuit board, so that the user can still conveniently built the connection between the plug and the receptacle. Moreover, the positioning plate increases the surface area of the insulated housing, thus electromagnetic interference and radiofrequency interference problems can be reduced.

Furthermore, since the upper-row plug terminals and the lower-row plug terminals are arranged upside down, and the pin-assignment of the flexible contact portions of the upper-row plug terminals is left-right reversal with respect to that of the flexible contact portions of the lower-row plug terminals. Accordingly, the electrical plug connector can have a 180 degree symmetrical, dual or double orientation design and pin assignments which enables the plug connector to be inserted into a corresponding receptacle connector in either of two intuitive orientations, i.e. in either upside-up or upside-down directions. Therefore, when the electrical plug connector is inserted into an electrical receptacle connector with a first orientation, the flexible contact portions of the upper-row plug terminals are in contact with upper-row receptacle terminals of the electrical receptacle connector. Conversely, when the electrical plug connector is inserted into the electrical receptacle connector with a second orientation, the flexible contact portions of the lower-row plug terminals are in contact with the upper-row receptacle terminals of the electrical receptacle connector. Note that, the inserting orientation of the electrical plug connector is not limited by the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 4C illustrates a schematic configuration diagram of the plug terminals of the electrical plug connector shown in FIG. 4B;

DETAILED DESCRIPTION

Figure 1:
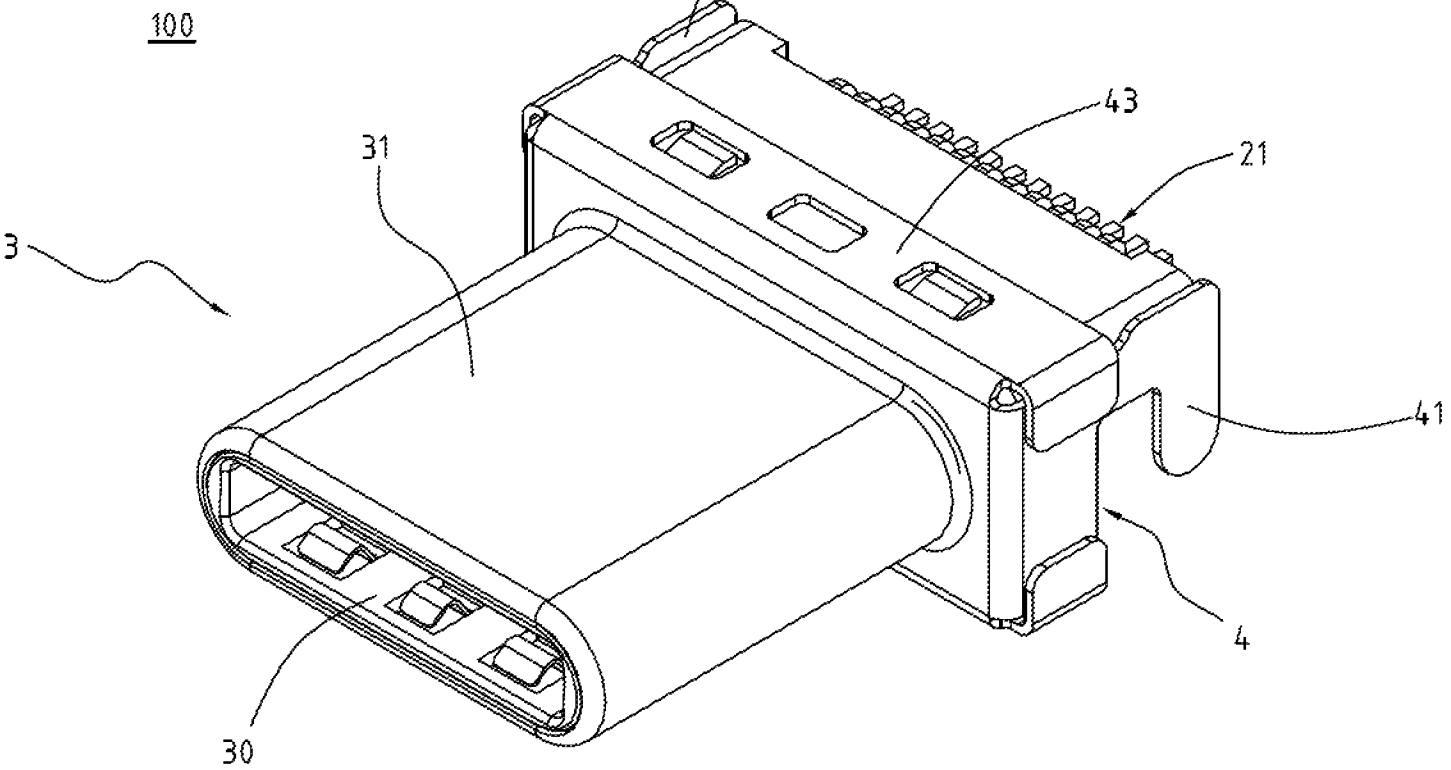
FIG. 1 illustrates a perspective view of an electrical plug connector of a first embodiment of the instant disclosure.
Figure 2:
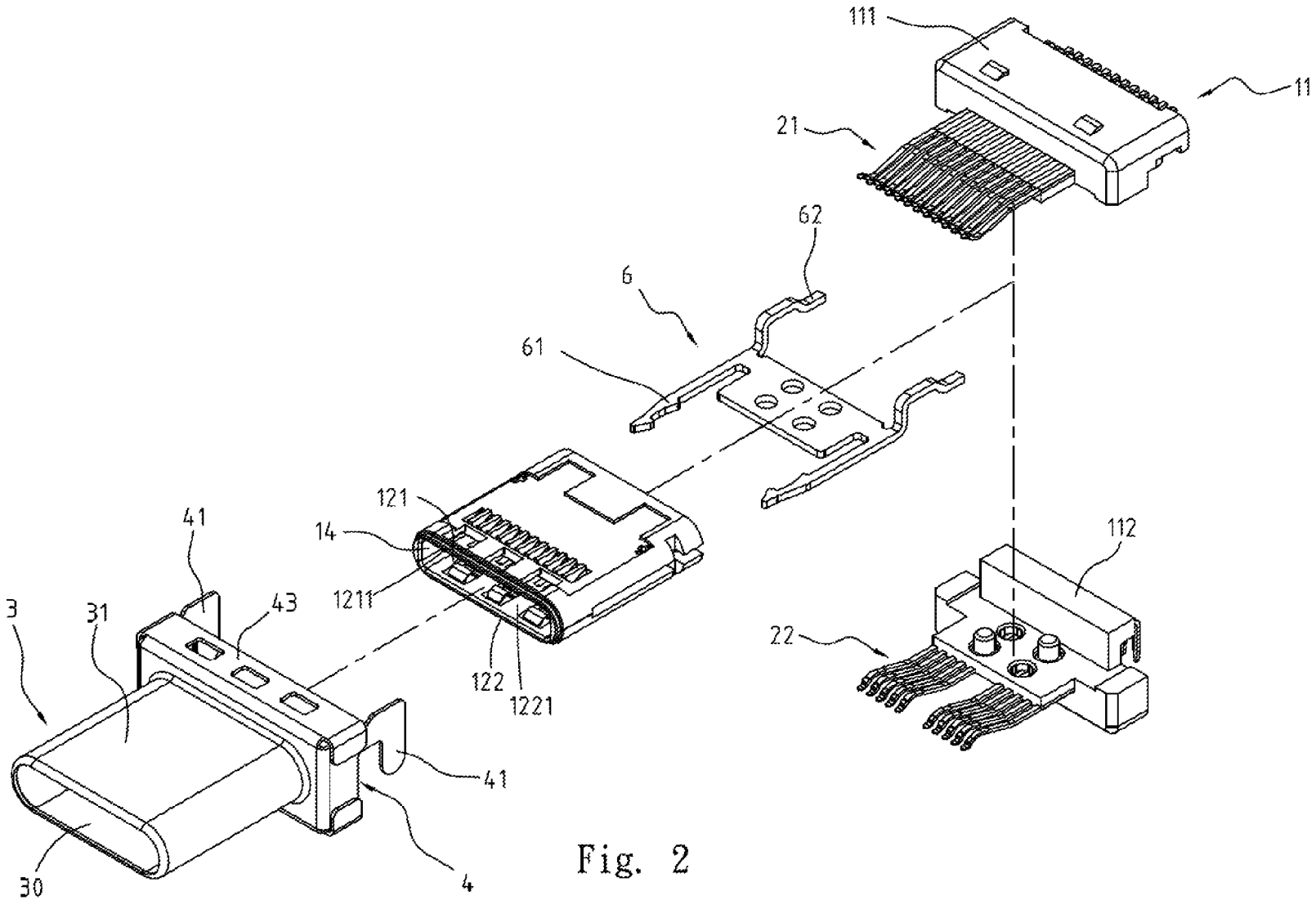
FIG. 2 illustrates an exploded view (1) of the electrical plug connector of the first embodiment of the instant disclosure.
Figure 3:
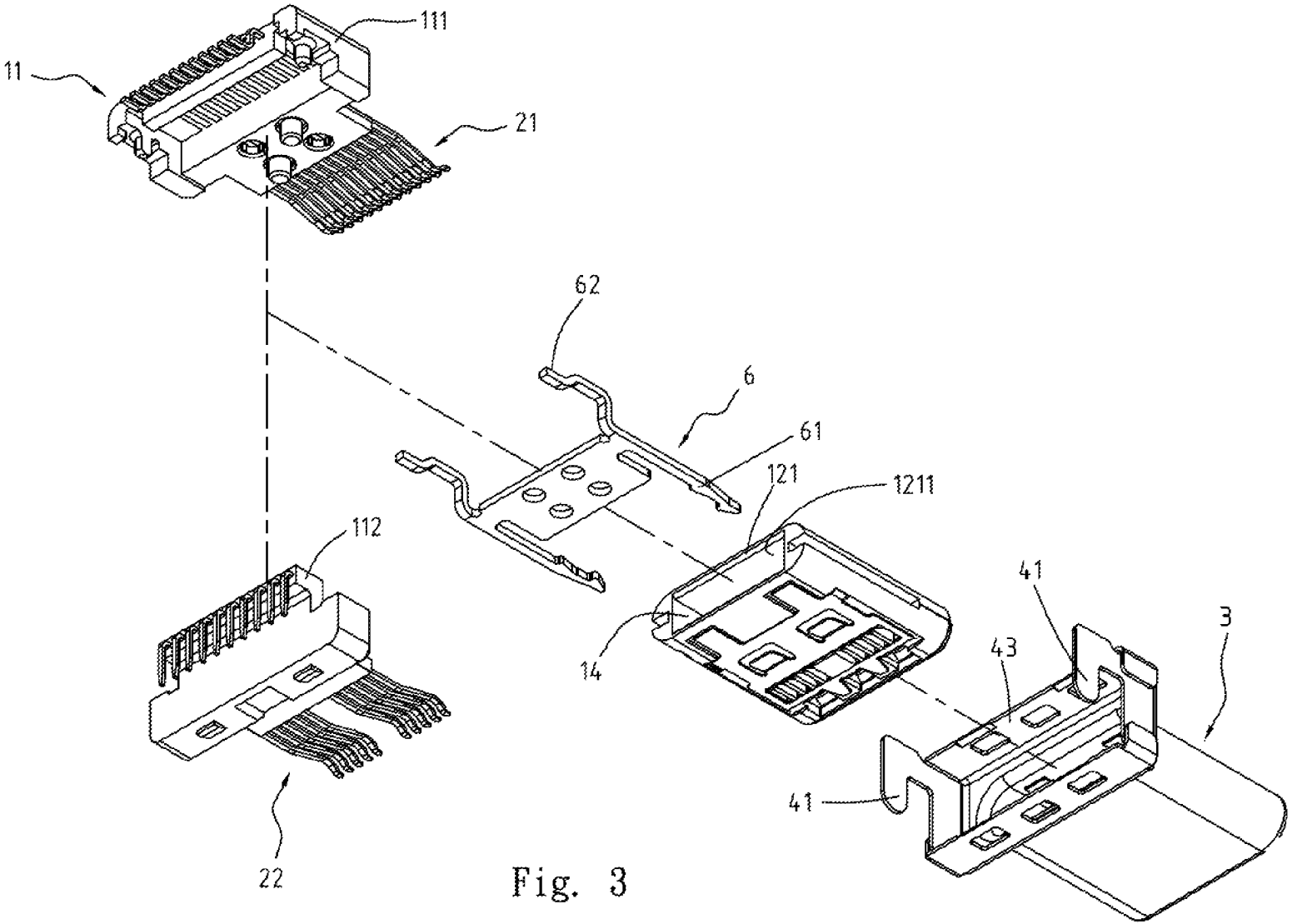
FIG. 3 illustrates an exploded view (2) of the electrical plug connector of the first embodiment of the instant disclosure.
Figure 4:
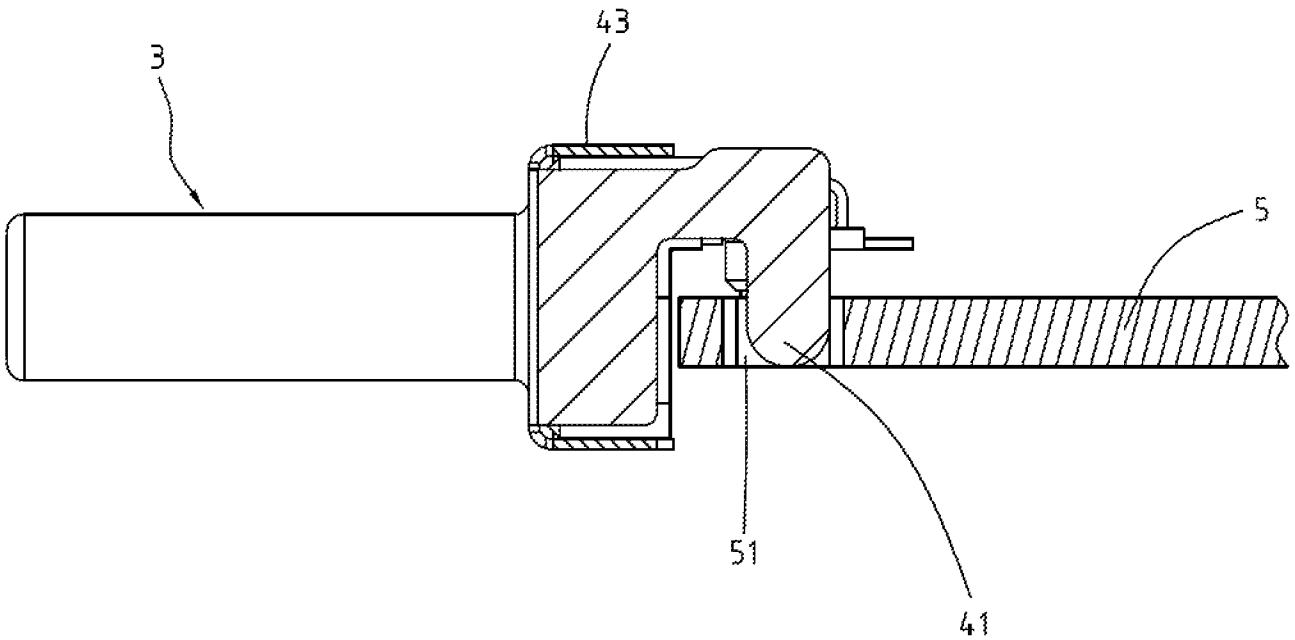
FIG. 4 illustrates a side view of the electrical plug connector of the first embodiment of the instant disclosure.
Figure 9:
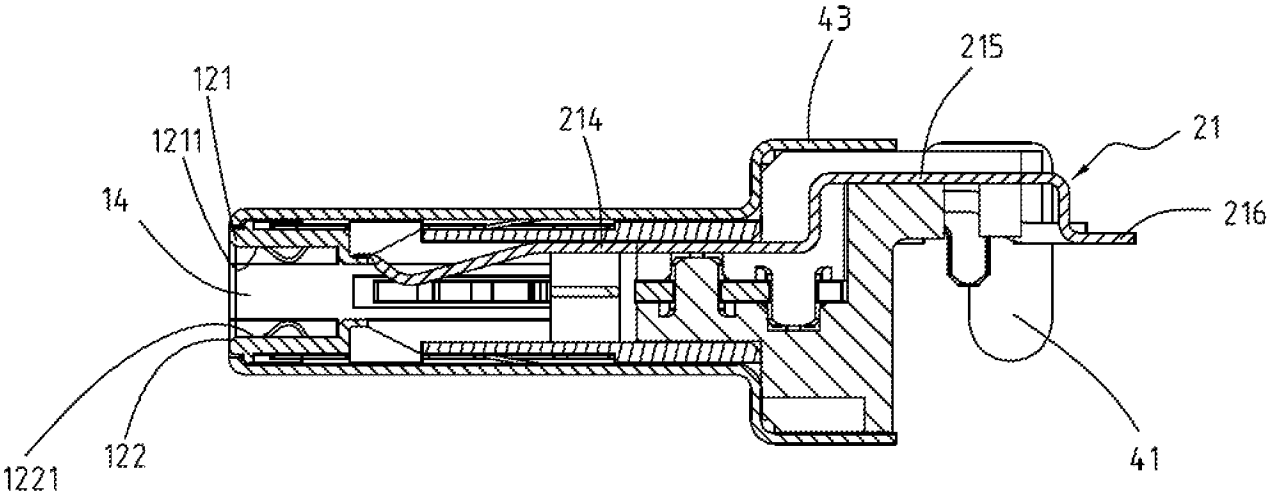
FIG. 9 illustrates a side sectional view showing an electrical plug connector having upper-row plug terminals of an exemplary embodiment of the instant disclosure.

FIG. 1 illustrates a perspective view of an electrical plug connector 100 of, a first embodiment of the instant disclosure. FIG. 2 illustrates an exploded view (1) of the electrical plug connector 100 of the first embodiment of the instant disclosure. FIG. 3 illustrates an exploded view (2) of the electrical plug connector 100 of the first embodiment of the instant disclosure. FIG. 4 illustrates a side view of the electrical plug connector 100 of the first embodiment of the instant disclosure. Please refer to FIGS. 1 to 4, which illustrate an electrical plug connector 100 of a first embodiment of the instant disclosure. In this embodiment, the electrical plug connector 100 can provide a reversible or dual orientation USB Type-C connector interface and pin assignments, i.e., a USB Type-C plug connector. In this embodiment, the electrical plug connector 100 comprises an insulated housing 1, a plurality of plug terminals 2, a metallic shell 3, and a positioning plate 4. In this embodiment, the plug terminals 2 comprise a plurality of upper-row plug terminals 21 and a plurality of lower-row plug terminals 22, but embodiments are not limited thereto. In some embodiments, the plug terminals 2 may comprise a plurality of upper-row plug terminals 21 or a plurality of lower-row plug terminals 22 in order to meet product requirements or cost consideration. For example, as shown in FIG. 9, the electrical plug connector 100 comprises a plurality of upper-row plug terminals 21.

Please refer to FIG. 2 and FIG. 3. The insulated housing 1 comprises a base portion 11, an upper portion 121, a lower portion 122, and a mating room 14. Here, the base portion 11, the upper portion 121, and the lower portion 122 of the insulated housing 1 are respectively injection molded or the like. In this embodiment, the upper portion 121 and the lower portion 122 are extending forward from one side of the base portion 11. The mating room 14 is defined between the upper portion 121 and the lower portion 122. Moreover, the upper portion 121 has an upper mating face 1211, the lower portion 122 has a lower mating face 1221, and the upper mating face 1211 is faced toward the lower mating face 1221.

Figure 4A:
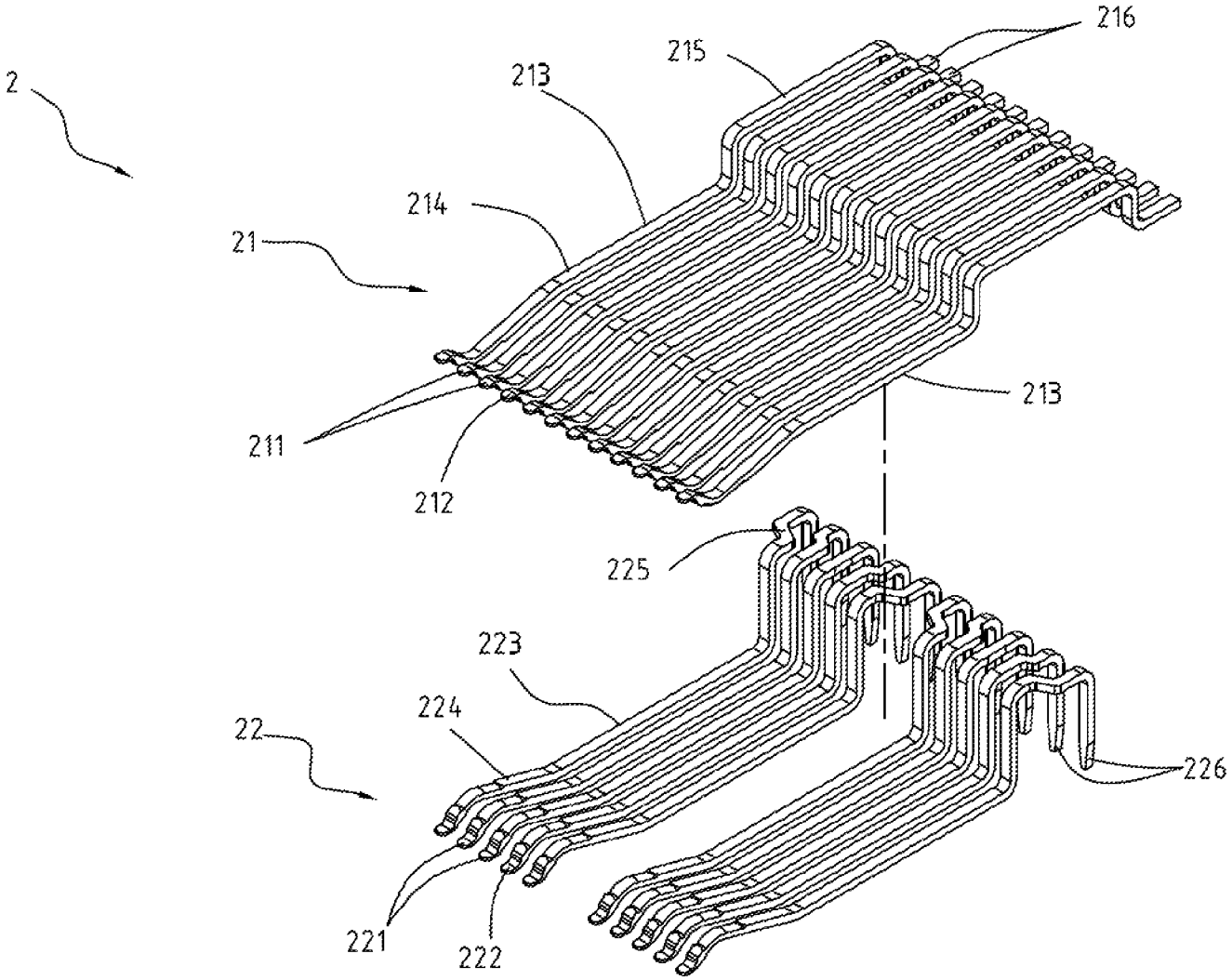
FIG. 4A illustrates an exploded view of upper-row plug terminals and lower-row plug terminals of the electrical plug connector of an exemplary embodiment of the instant disclosure.
Figure 4B:
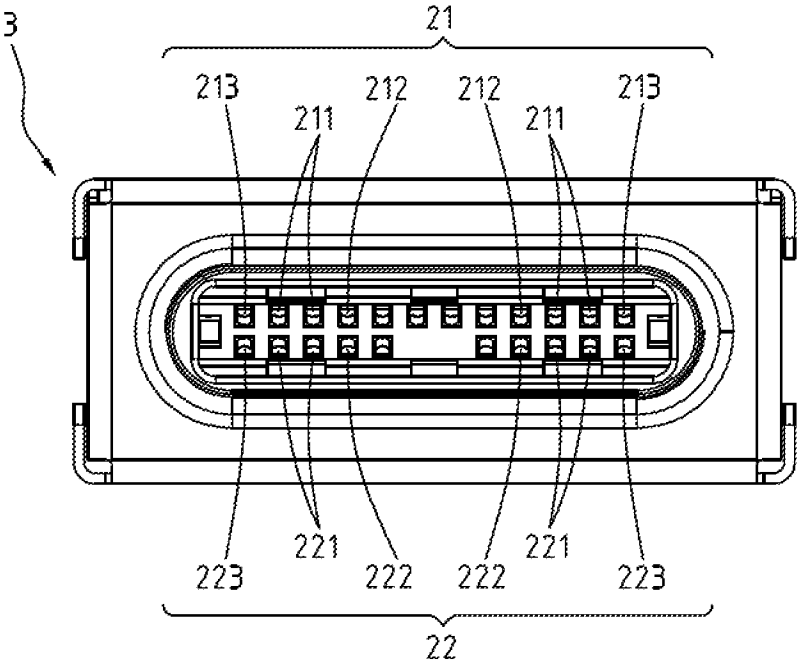
FIG. 4B illustrates a front sectional view of the electrical plug connector of the first embodiment of the instant disclosure.

Please refer to FIGS. 4A to 4C. FIG. 4A illustrates an exploded view of upper-row plug terminals 21 and lower-row plug terminals 22 of the electrical plug connector 100 of an exemplary embodiment of the instant disclosure. FIG. 4B illustrates a front sectional view of the electrical plug connector 100 of the first embodiment of the instant disclosure. FIG. 4C illustrates a schematic configuration diagram of the plug terminals 2 of the electrical plug connector 100 shown in FIG. 4B. The plug terminals 2 are configured in the base portion 11, the upper portion 121, and the lower portion 122. The plug terminals 2 comprise a plurality of upper-row plug terminals 21 and a plurality of lower-row plug terminals 22.

Please refer to FIGS. 4A to 4C. The upper-row plug terminals 21 are held in the upper portion 121 of the insulated housing 1 and partly exposed upon the upper mating face 1211 of the upper portion 121. Here, the upper-row plug terminals 21 comprise a plurality of upper signal pairs 211, at least one power terminal 212, and at least one ground terminal 213. Specifically, as shown in FIG. 4C, the upper-row plug terminals 21 comprise, from right to left, a ground terminal 213 (Gnd), a first upper signal pair (TX1+−) 211, a second upper signal pair (D+−) 211, a third upper signal pair (RX2+−) 211, two power terminals 212 (Power/VBUS) between the three pairs of upper signal pairs 211, a retain terminal (RFU), (the retain terminal and a configuration channel 1 (CC1) are respectively arranged between the power terminals 212 and the second upper signal pair (D+−) 211), and a ground terminal 213 (Gnd) at the leftmost.

Please refer to FIGS. 4A to 4C. Each of the upper-row plug terminals 21 comprises a flexible contact portion 214, a body portion 215, and a tail portion 216. For each of the upper-row plug terminals 21, the body portion 215 is held in the upper portion 121, the flexible contact portion 214 is extending forward from the body portion 215 in the rear-to-front direction and partly exposed upon the upper mating face 1211 of the upper portion 121, and the tail portion 216 is extending backward from the body portion 215 in the front-to-rear direction and protruded from the insulated housing 1. The upper signal pairs 211 partly project into the mating room 14 and are provided for transmitting first signals (i.e., USB 3.0 signals.). The tail portions 216 of the upper-row plug terminals 21 are extending from the rear of the insulated housing 1 and aligned horizontally to form flat legs, named SMT (surface mount technology) legs which can be soldered or mounted on the surface of a circuit board using surface mount technology, as shown in FIG. 4A. In some embodiments, the tail portions 216 of the upper-row plug terminals 21 may be extending downward to form vertical legs, named through-hole legs which can be soldered on the surface of a circuit board by through hole technology.

Please refer to FIGS. 4A to 4C. The lower-row plug terminals 22 are held in the lower portion 122 of the insulated housing 1 and partly exposed upon the lower mating face 1221 of the lower portion 122. Here, the lower-row plug terminals 22 comprise a plurality of lower signal pairs 221, at least one power terminal 222, and at least one ground terminal 223. Specifically, as shown in FIG. 4C, the lower-row plug terminals 22 comprise, from left to right, a ground terminal 223 (Gnd), a first lower signal pair (TX2+−) 221, a second lower signal pair (D+−) 221, a third lower signal pair (RX1+−) 221, two power terminals 222 (Power/VBUS) between the three pairs of lower signal pairs 221, a retain terminal (RFU), (the retain terminal and a configuration channel 2 (CC2) are respectively arranged between the power terminals 222 and the second lower signal pair (D+−) 221), and a ground terminal 223 (Gnd) at the rightmost.

Please refer to FIGS. 4A to 4C. Each of the lower-row plug terminals 22 comprises a flexible contact portion 224, a body portion 225, and a tail portion 226. For each of the lower-row plug terminals 22, the body portion 225 is held in the lower portion 122, the flexible contact portion 224 is extending forward from the body portion 225 in the rear-to-front direction and partly exposed upon the lower mating face 1221 of the lower portion 122, and the tail portion 226 is extending backward from the body portion 225 in the front-to-rear direction and protruded from the insulated housing 1. The lower signal pairs 221 partly project into the mating room 14 and are provided for transmitting second signals (i.e., USB 3.0 signals). The tail portions 226 of the lower-row plug terminals 22 are extending downward to form vertical legs, named through-hole legs which can be soldered on the surface of a circuit board by through hole technology, as shown in FIG. 4A. In some embodiments, the tail portions 226 are extending from the rear of the insulated housing 1 and aligned horizontally to form flat legs, named SMT legs which can be soldered or mounted on the surface of a circuit board using surface mount technology.

Please refer to FIGS. 4A to 4C. It is understood that, in this embodiment, the upper-row plug terminals 21 and the lower-row plug terminals 22 are respectively at the upper mating face 1211 of the upper portion 121 and the lower mating face 1221 of the lower portion 122. Additionally, pin-assignments of the upper-row plug terminals 21 and the lower-row plug terminals 22 are point-symmetrical with a central point of a receiving cavity 30 of the metallic shell 3 as the symmetrical center. Here, point-symmetry means that after the upper-row plug terminals 21 (or the lower-row plug terminals 22), are rotated by 180 degrees with the symmetrical center as the rotating center, the upper-row plug terminals 21 and the lower-row plug terminals 22 are overlapped. That is, the rotated upper-row plug terminals 21 are arranged at the position of the original lower-row plug terminals 22, and the rotated lower-row plug terminals 22 are arranged at the position of the original upper-row plug terminals 21. Accordingly, the electrical plug connector 100 can have a 180 degree symmetrical, dual or double orientation design and pin assignments which enables the electrical plug connector 100 to be inserted into a corresponding receptacle connector in either of two intuitive orientations, i.e. in either upside-up or upside-down directions. In other words, the upper-row plug terminals 21 and the lower-row plug terminals 22 are arranged upside down, and the pin assignment of the upper-row plug terminals 21 is left-right reversal with respect to that of the lower-row plug terminals 22. Accordingly, the electrical plug connector 100 is inserted into an electrical receptacle connector with a first orientation where the lower mating face 1221 of the lower portion 122 is facing up, for transmitting first signals. Conversely, the electrical plug connector 100 is inserted into the electrical receptacle connector with a second orientation where the lower mating face 1221 of the lower portion 122 is facing down, for transmitting second signals. Furthermore, the specification for transmitting the first signals is conformed to the specification for transmitting the second signals. Note that, the inserting orientation of the electrical plug connector 100 is not limited by the instant disclosure.

Please refer to FIGS. 4A to 4C. The position of the upper-row plug terminals 21 correspond to the position of the lower-row plug terminals 22.

Figure 5:
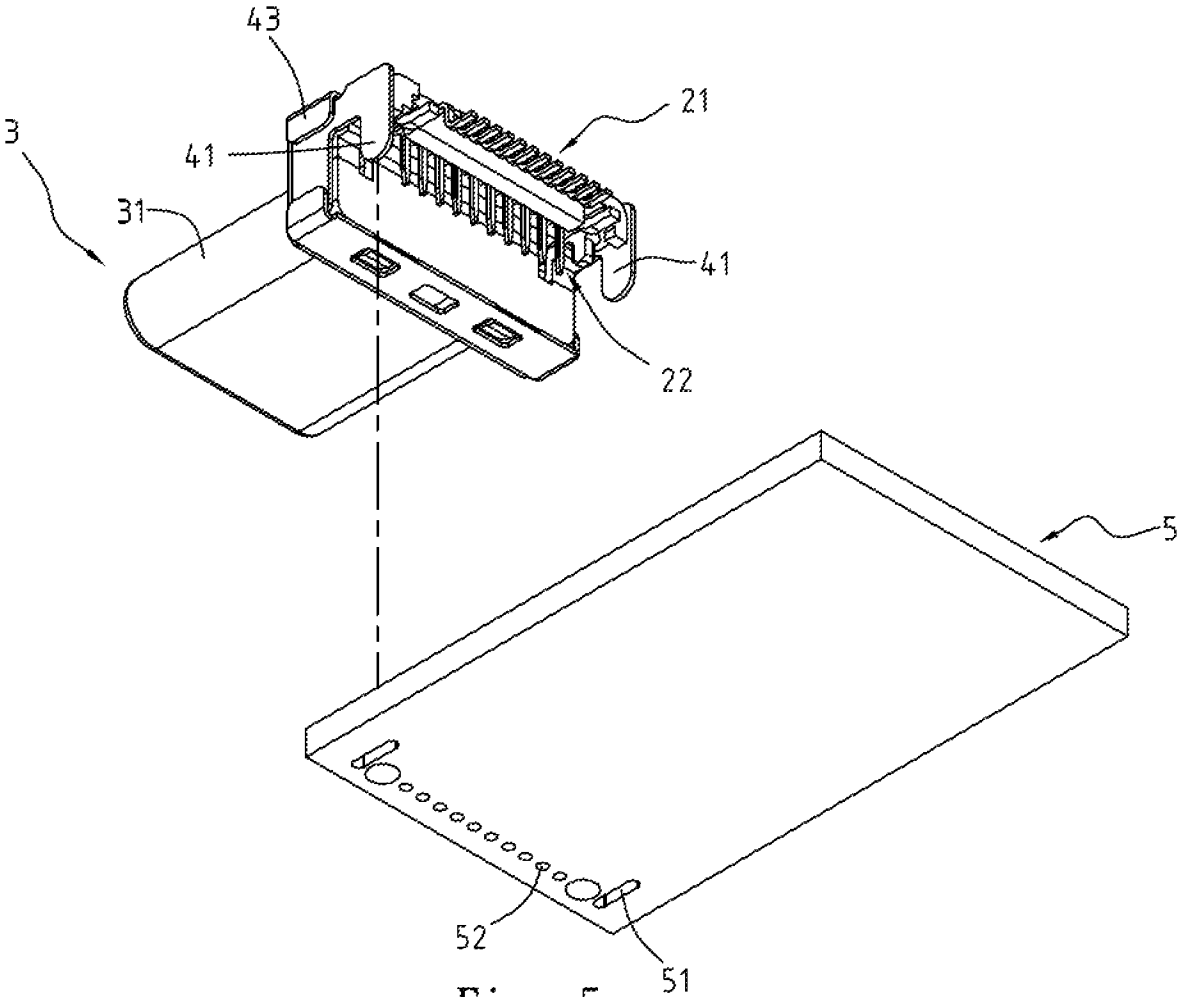
FIG. 5 illustrates an exploded view showing a circuit board is assembled with the electrical plug connector of the first embodiment of the instant disclosure.

FIG. 5 illustrates an exploded view showing a circuit board 5 is assembled with the electrical plug connector 100 of the first embodiment of the instant disclosure. Please refer to FIGS. 3 to 5. The metallic shell 3 is hollowed and defines a receiving cavity 30 therein; i.e., the metallic shell 3 comprises a tubular portion 31 and a receiving cavity 30 defined in the tubular portion 31. The metallic shell 3 encloses the insulated housing 1; i.e., the insulated housing 1 is received in the receiving cavity 30. In this embodiment, the metallic shell 3 is a multi-piece member, but embodiments are not limited thereto. Alternatively, in some embodiments, the metallic shell 3 may be formed by bending a unitary member.

Please refer to FIGS. 2 to 5. In this embodiment, the positioning plate 4 is at the rear of the metallic shell 3 to enclose the base portion 11. The positioning plate 4 comprises a plurality of legs 41 (or called a first leg and a second leg) respectively located at two sides of the base portion 11. In this embodiment, the positioning plate 4 and the metallic shell 3 are integrally formed as a whole. The positioning plate 4 is extending from the rear of the tubular portion 31 to enclose the base portion 11. The positioning plate 4 is vertical to the tubular portion 31 (i.e., the length direction of the tubular portion 31 is vertical to the width direction of the positioning plate 4). Portions of the positioning plate 31 are bent and folded to enclose the top, the bottom, and the two sides of the base portion 11. In this embodiment, the positioning plate 4 comprises a plurality of buckling sheets 43 assembled to the top and the bottom of the base portion 11, respectively. Each of the legs 41 is approximately formed as hook shaped. In addition, the buckling sheets 43 are abutted between the top and the bottom of each of the legs 41, so that the positioning force provided by the legs 41 can be improved.

Please refer to FIGS. 2 to 5. The electrical plug connector 100 further comprises a circuit board 5 assembled to the bottom of the base portion 11. The circuit board 5 comprises a plurality of through holes 51 and a plurality of contacts 52. The legs 41 of the positioning plate 4 are inserted into the through holes 51 and positioned with the through holes 51 by soldering means. The bottom of the base portion 11 further comprises protruded blocks which are capable of passing through the through holes 51 for improving the structural strength between the base portion 11 and the circuit board 5. The upper-row plug terminals 21 and the lower-row plug terminals 22 are soldered on the contacts 52. In this embodiment, the contacts 52 may be in the format of joints or via holes. The types of the contacts 52 depend on what kind of the tail portions 216, 226 of the plug terminals 2 is. In other words, when the tail portions 216, 226 of the plug terminals 2 are SMT legs, the contacts 52 are joints; while when the tail portions 216, 226 of the plug terminals 2 are through-hole legs, the contacts 52 are via holes.

The contacts 52 are at a first side of the circuit board 5. The circuit board 5 further comprises a plurality of second contacts configured on a second side of the circuit board 5, and the second side is opposite to the first side. The second contacts are provided for soldered with wires. Therefore, an enveloping shell encloses the circuit board 5 by over molding or the like, and an electrical plug connector 100 with transmission wires can be provided. In addition, the electrical plug connector 100 may further comprise a covering shell. The covering shell may be a multi-piece member. The covering shell further comprises an upper shell and a lower shell combined with each other. The upper shell and the lower shell are respectively located at the upper side and the lower side of the circuit board 5, and the circuit board 5 is abutted between the upper shell and the lower shell.

Please refer to FIGS. 2 to 5. The base portion 11 of the electrical plug connector 100 further comprises an upper base 111 and a lower base 112 assembled with each other. The upper base 111 is assembled to the rear of the upper-row plug terminals 21, and the lower base 112 is assembled to the rear of the lower-row plug terminals 22. In addition, the electrical plug connector 100 further comprises a grounding plate 6 disposed at the insulated housing 1, between the upper-row plug terminals 21 and the lower-row plug terminals, and in contact with the circuit board 5. In this embodiment, the grounding plate 6 is between the upper base 111 and the lower base 112. The upper base 111 and the lower base 112 have mating structures to be assembled with each other. In addition, the grounding plate 6 has thru holes to be passed through by the mating structures, so that the grounding plate 6 can be assembled between the upper base 111 and the lower base 112. Moreover, the grounding plate 6 may be, but not limited to, formed by blanking technique. In some embodiments, the grounding plate 6 may be formed by stamping technique. It is understood that the structural strength of the grounding plate 6 formed by blanking technique is greater than that of the grounding plate 6 formed by stamping technique. The grounding plate 6 comprises a plurality of side arms 61 and a plurality of grounding legs 62. The side arms 61 are partly projected into the mating room 14. The grounding legs 62 are provided for soldered with the contacts 52 of the circuit board 5.

Figure 6:
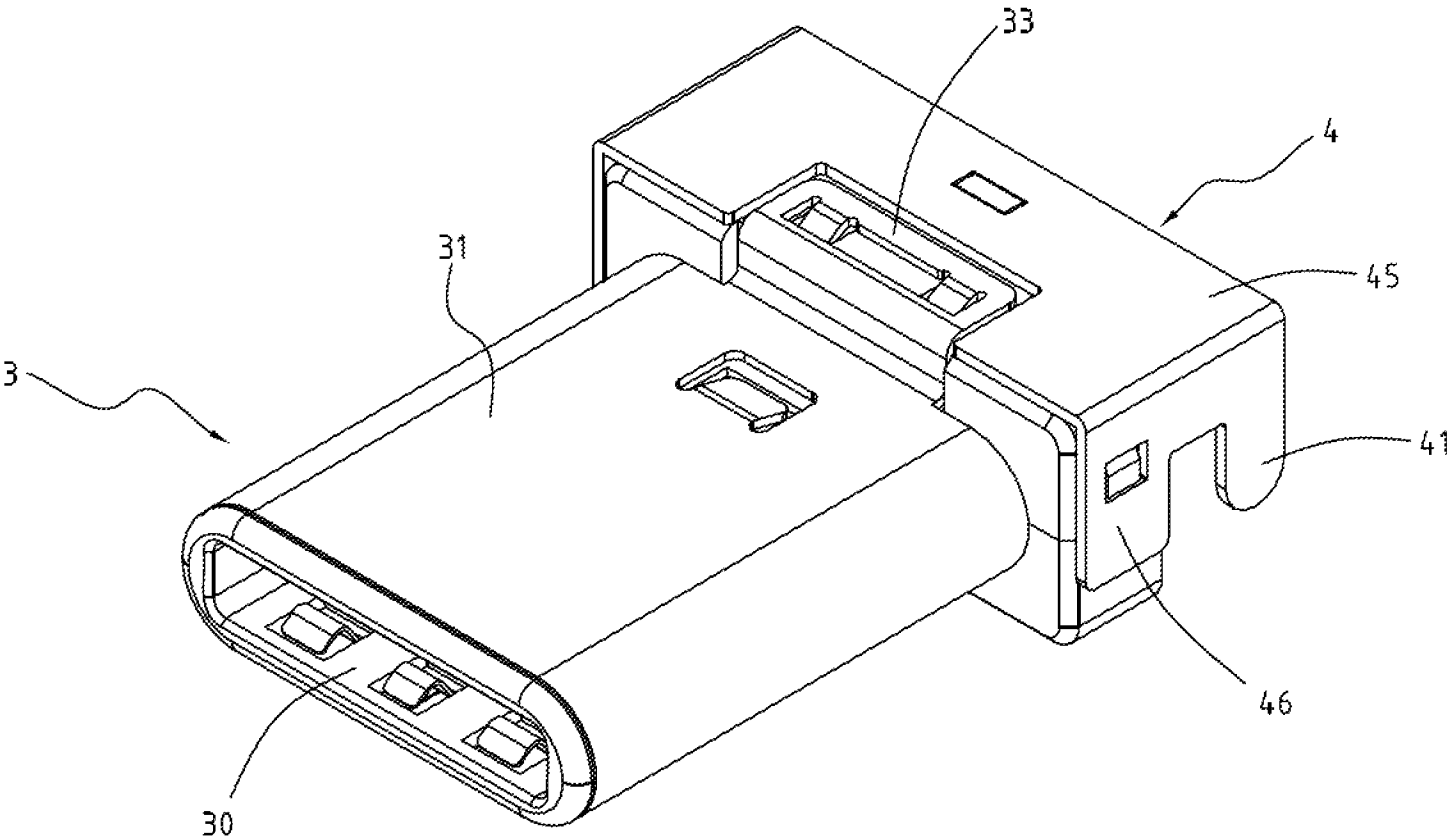
FIG. 6 illustrates a perspective view of an electrical plug connector of a second embodiment of the instant disclosure.
Figure 7:
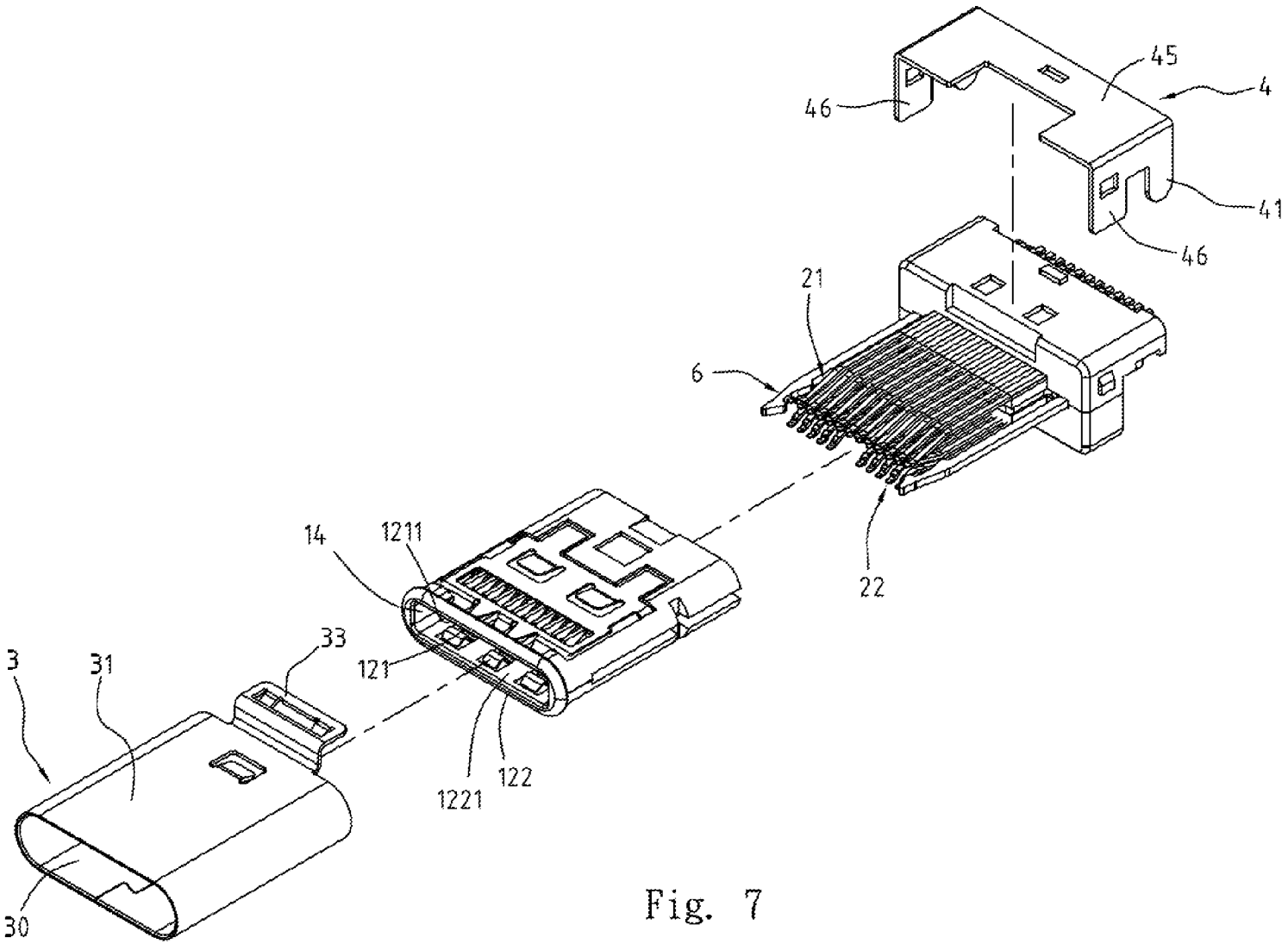
FIG. 7 illustrates an exploded view of the electrical plug connector of the second embodiment of the instant disclosure.
Figure 8:
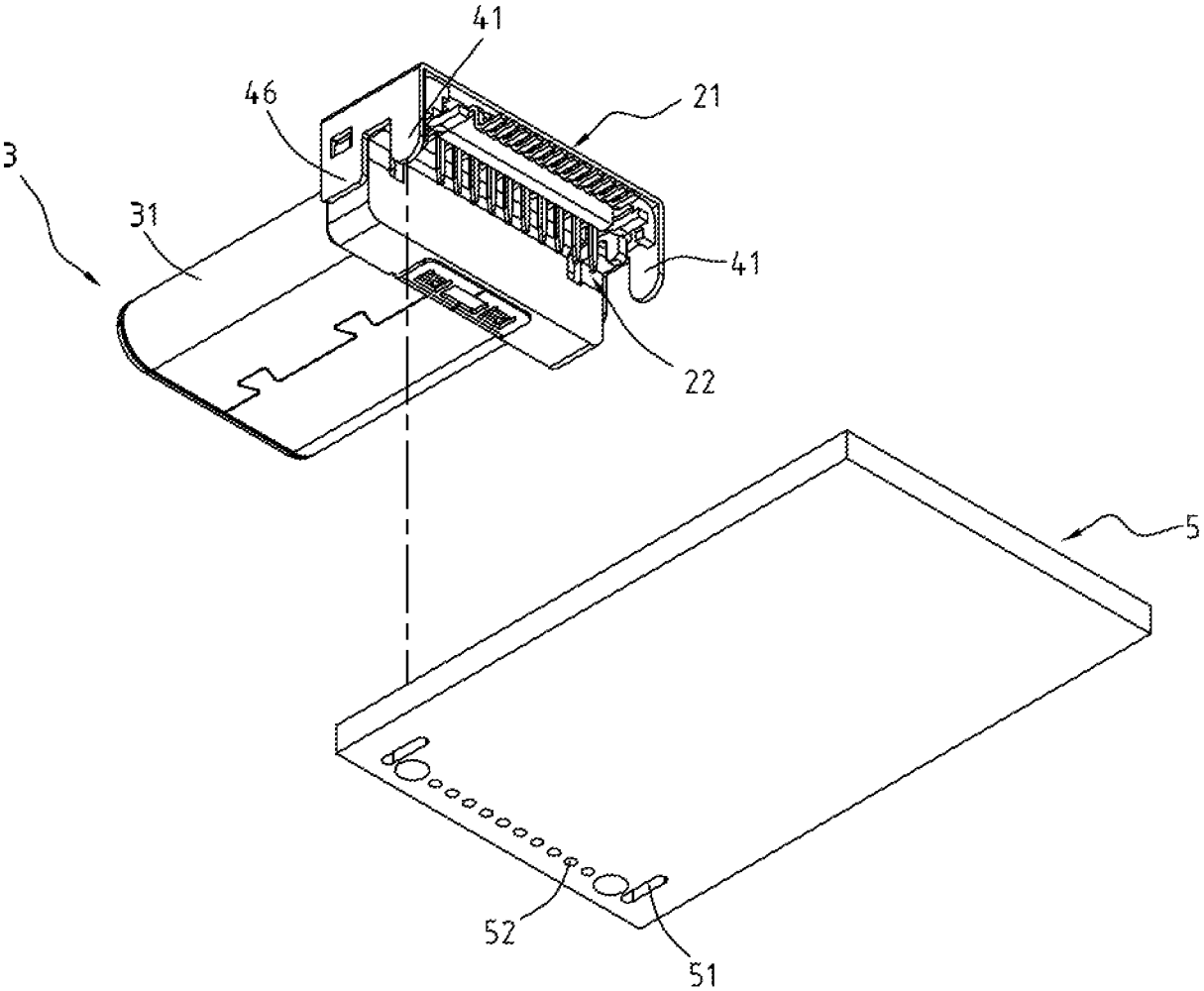
FIG. 8 illustrates an exploded view showing a circuit board is assembled with the electrical plug connector of the second embodiment of the instant disclosure.

FIG. 6 illustrates a perspective view of an electrical plug connector 100 of a second embodiment of the instant disclosure. FIG. 7 illustrates an exploded view of the electrical plug connector 100 of the second embodiment of the instant disclosure. FIG. 8 illustrates an exploded view showing a circuit board 5 is assembled with the electrical plug connector 100 of the second embodiment of the instant disclosure. Please refer to FIGS. 6 to 8, which illustrate a second embodiment of the instant disclosure. In this embodiment, the positioning plate 4 and the metallic shell 3 are separated pieces. The positioning plate 4 comprises a top plate 45 assembled to the top of the base portion 11, and of the legs 41 of the positioning plate 4 are extending from two sides of the top plate 45 and respectively located at two sides of the base portion 11. In other words, in the first embodiment, the positioning plate 4 and the metallic shell 3 are formed integrally as a whole by drawing technique; while in the second embodiment, the positioning plate 4 and the metallic shell 3 are manufactured and processed separately, and the positioning plate 4 and the metallic shell 3 are combined with the insulated housing 1 by assembling. In addition, the positioning plate 4 may further comprises a plurality of side plates 46 located at the two sides of the top plate 45 and assembled to the two sides of the base portion 11. In this embodiment, each of the side plates 46 has an engaging hole, and buckling blocks are protruded from the two sides of the base portion 11 to be mated with the engaging holes. Furthermore, the metallic shell 3 further may comprise a plurality of buckling pieces 33 extending from the rear of the tubular portion 31 to be assembled on the top and the bottom of the base portion 11. In this embodiment, each of the buckling pieces 33 has a buckling hole, and buckling blocks are protruded from the top and the bottom of the base portion 11 to be mated with the buckling holes.

Based on the above, the legs of the positioning plate are located at the two sides of the base portion, extending from the bottom of the base portion, and assembled to the circuit board, so that the legs can be soldered with the circuit board, and the fixation between the base portion and the circuit board can be improved. As a result, the insulated housing would not detach from the circuit board easily when a bending test is applied to the electrical plug connector, and the tail portions of the upper-row plug terminals and the tail portions of the lower-row plug terminals would not detach from the circuit board. Consequently, the fixation between the insulated housing and the circuit board, and the structural strength of the electrical plug connector can be improved efficiently. In addition to the soldering between the plug terminals of the electrical plug connector and the contacts of the circuit board, the legs of the positioning plate are engaged with the circuit board, so that the fixation between the electrical plug connector and the circuit board can be further improved. Therefore, after the electrical plug connector is plugged or unplugged into an electrical receptacle connector for several times, the electrical plug connector would not be tilted with respect to the circuit board, so that the user can still conveniently built the connection between the plug and the receptacle. Moreover, the positioning plate increases the surface area of the insulated housing, thus electromagnetic interference and radiofrequency interference problems can be reduced.

Furthermore, since the upper-row plug terminals and the lower-row plug terminals are arranged upside down, and the pin-assignment of the flexible contact portions of the upper-row plug terminals is left-right reversal with respect to that of the flexible contact portions of the lower-row plug terminals. Accordingly, the electrical plug connector can have a 180 degree symmetrical, dual or double orientation design and pin assignments which enables the plug connector to be inserted into a corresponding receptacle connector in either of two intuitive orientations, i.e. in either upside-up or upside-down directions. Therefore, when the electrical plug connector is inserted into an electrical receptacle connector with a first orientation, the flexible contact portions of the upper-row plug terminals are in contact with upper-row receptacle terminals of the electrical receptacle connector. Conversely, when the electrical plug connector is inserted into the electrical receptacle connector with a second orientation, the flexible contact portions of the lower-row plug terminals are in contact with the upper-row receptacle terminals of the electrical receptacle connector. Note that, the inserting orientation of the electrical plug connector is not limited by the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

an insulated housing, comprising a base portion, an upper portion, a lower portion, and a mating room, wherein the upper portion and the lower portion are extending from one side of the base portion, and the mating room is between the upper portion and the lower portion, the upper portion has an upper mating face, the lower portion has a lower mating face, and the upper mating face is faced toward the lower mating face;

a plurality of upper-row plug terminals, held in the insulated housing and located upon the upper mating face of the upper portion, wherein the upper-row plug terminals comprise a plurality of upper signal pairs, at least one power terminal, and at least one ground terminal;

a plurality of lower-row plug terminals, held in the insulated housing and located upon the lower mating face of the lower portion, wherein the lower-row plug terminals comprise a plurality of lower signal pairs, at least one power terminal, and at least one ground terminal;

a metallic shell, comprising a tubular portion and a receiving cavity defined in the tubular portion, wherein the insulated housing is received in the receiving cavity of the tubular portion; and a positioning plate, at the rear of the metallic shell, wherein the positioning plate comprises a first leg and a second leg respectively located at two sides of the base portion.

2. The electrical plug connector according to claim 1, wherein the positioning plate and the metallic shell are integrally formed as a whole, the positioning plate is extending from the rear of the tubular portion to enclose the base portion, the positioning plate comprises a plurality of buckling sheets assembled to the top and the bottom of the base portion, respectively, and the buckling sheets are abutted between the top and the bottom of each of the legs.

3. The electrical plug connector according to claim 1, wherein the positioning plate and the metallic shell are separated pieces, the positioning plate comprises a top plate assembled to the top of the base portion, and each of the legs is extending from two sides of the top plate.

4. The electrical plug connector according to claim 3, wherein the positioning plate further comprises a plurality of side plates located at the two sides of the top plate and assembled to the two sides of the base portion, the metallic shell comprises a plurality of buckling pieces extending from the rear of the tubular portion to be assembled on the top and the bottom of the base portion.

5. The electrical plug connector according to claim 1, further comprising a circuit board assembled to the bottom of the base portion, wherein the circuit board comprises a plurality of through holes and a plurality of contacts, the through holes are positioned with the legs, and the contacts are soldered with the upper-row plug terminals and the lower-row plug terminals.

6. The electrical plug connector according to claim 5, further comprising a grounding plate disposed at the insulated housing, between the upper-row plug terminals and the lower-row plug terminals, and in contact with the circuit board.

7. The electrical plug connector according to claim 1, wherein each of the upper-row plug terminals further comprises a flexible contact portion, a body portion, and a tail portion, wherein the body portion is held in the upper portion, the flexible contact portion is extending forward from the body portion in the rear-to-front direction and partly exposed upon the upper mating face of the upper portion, and the tail portion is extending backward from the body portion in the front-to-rear direction and protruded from the insulated housing.

8. The electrical plug connector according to claim 1, wherein each of the lower-row plug terminals further comprises a flexible contact portion, a body portion, and a tail portion, wherein the body portion is held in the lower portion, the flexible contact portion is extending forward from the body portion in the rear-to-front direction and partly exposed upon the lower mating face of the lower portion, and the tail portion is extending backward from the body portion in the front-to-rear direction and protruded from the insulated housing.

9. The electrical plug connector according to claim 1, wherein the upper-row plug terminals and the lower-row plug terminals have 180 degree symmetrical design with respect to a central point of the receiving cavity as the symmetrical center.

10. An electrical plug connector, comprising:

an insulated housing, comprising a base portion, an upper portion, a lower portion, and a mating room, wherein the upper portion and the lower portion are extending from one side of the base portion, and the mating room is between the upper portion and the lower portion, the upper portion has an upper mating face, the lower portion has a lower mating face, and the upper mating face is faced toward the lower mating face;

a plurality of upper-row plug terminals, held in the insulated housing and located upon the upper mating face of the upper portion, wherein the upper-row plug terminals comprise a plurality of upper signal pairs, at least one power terminal, and at least one ground terminal;

a metallic shell, comprising a tubular portion and a receiving cavity defined in the tubular portion, wherein the insulated housing is placed in the receiving cavity of the tubular portion; and a positioning plate, disposed at the rear of the metallic shell, wherein the positioning plate comprises a first leg and a second leg respectively located at two sides of the base portion.

11. An electrical plug connector, comprising:

an insulated housing, comprising a base portion, an upper portion, a lower portion, and a mating room, wherein the upper portion and the lower portion are extending from one side of the base portion, and the mating room is between the upper portion and the lower portion, the upper portion has an upper mating face, the lower portion has a lower mating face, and the upper mating face is faced toward the lower mating face;

a plurality of lower-row plug terminals, held in the insulated housing and located upon the lower mating face of the lower portion, wherein the lower-row plug terminals comprise a plurality of lower signal pairs, at least one power terminal, and at least one ground terminal;

a metallic shell, comprising a tubular portion and a receiving cavity defined in the tubular portion, wherein the insulated housing is placed in the receiving cavity of the tubular portion; and a positioning plate, disposed at the rear of the metallic shell, wherein the positioning plate comprises a first leg and a second leg respectively located at two sides of the base portion.

* * * * *